US009371665B2

(12) United States Patent
Herpin et al.

(10) Patent No.: US 9,371,665 B2
(45) Date of Patent: Jun. 21, 2016

(54) ARTICLE OF THE TENT OR SHELTER TYPE

(75) Inventors: Sophie Herpin, Lille (FR); Bruno Michalak, Tourcoing (FR)

(73) Assignee: DECATHLON, Villeneuve d'Ascq. (FR)

( * ) Notice: Subject to any disclaimer, the term of this patent is extended or adjusted under 35 U.S.C. 154(b) by 53 days.

(21) Appl. No.: 14/122,254

(22) PCT Filed: Jun. 14, 2012

(86) PCT No.: PCT/FR2012/051332

§ 371 (c)(1),
(2), (4) Date: Jan. 2, 2014

(87) PCT Pub. No.: WO2012/172256

PCT Pub. Date: Dec. 20, 2012

(65) Prior Publication Data

US 2014/0190540 A1 Jul. 10, 2014

(30) Foreign Application Priority Data

Jun. 16, 2011 (FR) ..... 11 55264

(51) Int. Cl.
*E04H 15/54* (2006.01)
*E04H 15/40* (2006.01)
*E04H 15/20* (2006.01)

(52) U.S. Cl.
CPC ..... *E04H 15/54* (2013.01); *E04H 15/40* (2013.01); *E04H 2015/207* (2013.01)

(58) Field of Classification Search
CPC ... E04H 15/54; E04H 15/18; E04H 2015/207; E04H 15/12; E04H 15/36; E04H 15/40
USPC ..... 135/91, 95, 97, 124, 136–137, 115
See application file for complete search history.

(56) References Cited

U.S. PATENT DOCUMENTS

| | | | | |
|---|---|---|---|---|
| 3,244,186 | A | 4/1966 | Thomason et al. | |
| 3,598,133 | A * | 8/1971 | Abert et al. | 135/94 |
| 4,065,889 | A * | 1/1978 | Fraioli | 52/2.23 |
| 4,308,882 | A * | 1/1982 | Pusch et al. | 135/93 |
| 4,467,005 | A | 8/1984 | Pusch et al. | |
| 4,996,970 | A * | 3/1991 | Legare | 126/205 |
| 5,421,355 | A * | 6/1995 | Cantwell | 135/115 |
| 5,750,242 | A | 5/1998 | Culler | |
| 7,882,849 | B2 * | 2/2011 | Franta | 135/115 |
| 2009/0188539 | A1 * | 7/2009 | Hollinger | 135/115 |
| 2010/0059095 | A1 | 3/2010 | Hinz et al. | |
| 2010/0190401 | A1 | 7/2010 | Mangold | |
| 2012/0227990 | A1 * | 9/2012 | Burnham | 169/48 |

FOREIGN PATENT DOCUMENTS

DE 20306171 U1 7/2003

* cited by examiner

*Primary Examiner* — Winnie Yip
(74) *Attorney, Agent, or Firm* — Bookoff McAndrews, PLLC

(57) ABSTRACT

The present invention relates to an article (1) of the tent or shelter type including a roof element (2) at least partially covering a shelter area (3), said roof element including a main flexible panel (4) having opposite outer (4*a*) and inner (4*b*) faces, the inner face (4*b*) being intended during operation to be oriented across from said shelter area (3). Characteristically, the inner face (4*b*) has an emissivity rate (%) of far infrared rays lower than the emissivity rate (%) of far infrared rays of the outer face (4*a*).

22 Claims, 2 Drawing Sheets

| | Transmission (%) | Reflection % | Absorption (%) | Emissivity inner face (%) | Emissivity outer face (%) |
|---|---|---|---|---|---|
| Sample 1 State of the art | 34 | 27 | 39 | - | 80 |
| Sample 2 | 7 | 50 | 43 | - | 55 |
| Sample 3 | 20 | 44 | 36 | - | 79 |
| Sample 4 | 8 | 56 | 36 | 58 | 83 |

ARTICLE OF THE TENT OR SHELTER TYPE

TECHNICAL FIELD OF THE DISCLOSURE

The present invention relates to the technical field of articles of the tent or shelter type including a roof element at least partially covering the shelter area, more particularly those suitable for thermally insulating the user(s) located in the shelter area so as to improve their comfort, in particular in the summer in high heat.

BACKGROUND OF THE DISCLOSURE

Generally, the tents also include an inner room covered by said roof element serving as a shelter area.

In the summer, it has been observed that the temperature in these shelter areas exposed to the sun, in particular in the inner rooms, is higher than the temperature outside said shelter area, also designated in this text as the ambient temperature. A temperature difference has thus been measured, as an example at European latitudes, of up to 15° C. between the temperature of the air in the upper areas of the inner room and the temperature of the ambient air outside said tent-type article. Furthermore, it has been observed that the presence of thermal radiation in the inner room implies that the temperature felt (radiant temperature) by a user is higher than that actually measured in that room, which further accentuates the heat-related discomfort.

As a result, the user cannot remain in a tent or shelter exposed to full daytime sunshine without suffering even greater heat than that found outside said shelter area.

This temperature difference between the shelter area, in particular the inner room, and the atmosphere is due on the one hand to a key contribution by solar radiation, and on the other hand to insufficient ventilation of the shelter area, in particular the inner room.

A greenhouse effect has in fact been observed, related to the solar radiation, that occurs in the shelter area. The roof elements allow part of the incident solar radiation to pass, which is made up of ultraviolet (UV), visible, and near infrared radiations in the short wavelength range (from 0.2 μm to 2 μm). However, said roof elements do not allow the far infrared radiation with long wavelengths (greater than 5 μm) emitted and reflected by the shelter area, in particular through the walls of the inner room, the floor and optionally the users in that area, to escape outside said shelter area.

These far infrared rays reflected and emitted by the shelter area are then primarily captured in the latter and accumulate, thereby increasing the temperature inside the shelter area, as well as on the walls of the inner room when one is provided. This greenhouse effect is still more significant in an inner room.

Thus known from document US-2010/0059095 is a shelter with a reversible roof including a dark-colored winter face to heat the area of the shelter in which one or more people are housed and a summer face with a light color so as to cool the shelter area by reflecting the rays of the sun. In summertime, the light face makes it possible to prevent the temperature in the shelter area from being too high relative to the atmosphere. However, the temperature in the shelter area still remains very high, and there is a need to improve the thermal comfort of the users.

Also known in U.S. Pat. No. 3,244,186 is a tent comprising a summer part and a winter part that can be interchanged by a 180° rotation around its vertical axis without it being necessary to reverse the latter from the inside or the outside. In FIG. 1, U.S. Pat. No. 3,244,186 describes an alternative in which the tent is provided with a reflective coating on its outer face, for example, a reflective aluminum paint, and on its inner face, with a coating absorbing the heat, for example, a non-reflective black paint. During operation, when the tent is exposed to the sun's rays, the inner face absorbs and stores more heat than the outer face and retransmits more far infrared rays than the outer face, thereby creating heating of the shelter area that the tent covers.

SUMMARY OF THE DISCLOSURE

The present invention thus aims to propose an article of the tent or shelter type making it possible to improve the thermal comfort in the shelter area, in particular in the inner room, while preserving a light article that is easy to manufacture, foldable, and has the basic characteristics of such a type of article: impermeable to water and permeable to air, withstanding operation and tearing.

The present invention offsets the aforementioned problems in that it relates to an article of the tent or shelter type including a roof element at least partially covering a shelter area, said roof element including a flexible main panel having opposite outer and inner faces, the inner face being intended during operation to be oriented across from said shelter area, the outer face being intended during operation to be oriented across from the sun's rays.

Characteristically, the inner face has an emissivity rate (%) of far infrared rays lower than the emissivity rate (%) of far infrared rays of the outer face, and the outer face is arranged so as to reflect the solar rays.

Advantageously, the fraction of the solar radiation absorbed by the roof element is better reemitted in the atmosphere than in the shelter area. This technical effect makes it possible to greatly attenuate the greenhouse effect observed in the state of the art, since fewer far infrared rays will be reemitted in the shelter area and capable of building up. Thus, the thermal radiation in the shelter area (floor, users, optionally walls of the room) is decreased and thus, correlatively, the radiant temperature perceived by the user, which improves his thermal comfort.

The combination of the reflective properties of the outer face with the emissivity difference between the inner and outer faces of the main panel makes it possible to further attenuate the greenhouse effect that may occur in the shelter area. In fact, a smaller portion of the incident solar rays will be transmitted, then reemitted in said shelter area, in particular less radiation in the far infrared will be able to build up in said area. The thermal comfort of the user in the shelter area is thus further improved.

The emissivity ($\epsilon$) is the property of the surface of a body to emit heat by radiation, expressed by the ratio between the energy radiated by that surface and that radiated by a black body at the same temperature. A black body is a theoretical object that absorbs all of the electromagnetic radiations that it receives, at all wavelengths. No electromagnetic radiation passes through it and none is reflected.

Emissivity thus depends on many parameters, namely the temperature of the body in question, the direction of the radiation, the wavelength, and above all, the surface state of the inner and outer faces of the main panel.

Reflection refers to the phenomenon by which a wave falling on the separating surface of two propagation media provided with different properties returns to the medium from which it comes; in particular involving the main flexible panel, the outer face serves as first medium while the ambient air in which the outer face emerges serves as second medium.

Transmission of a radiation refers to the passage of a radiation through a medium, without changing wavelength, in particular through the main flexible panel.

The solar rays according to the invention cover the solar spectrum, which in particular includes the visible, near infrared and ultraviolet rays.

The far infrared (FIR) is part of the thermal rays emitted by the different bodies, such as the ground, the main flexible panel, any inner room, objects positioned in the shelter area, and lastly and above all one or more users located in the shelter area. The waves in the far infrared penetrate the skin without damage and heat the tissues of the user's body similarly to the sun, but without the harmful radiation of ultraviolet rays.

Far infrared refers to any radiation having wavelengths greater than or equal to 5 μm.

Absorption of radiation refers to the penetration, retention and assimilation of said radiation in the thickness of the material, in the case of the present invention in the main flexible panel.

The reflection, transmission, and absorption rates are defined as the fraction of the incident radiation, in particular the solar radiation, which is respectively reflected, transmitted or absorbed.

Emissivity, transmission, and absorption make up the radiative properties of the main flexible panel.

Atmosphere refers to everything positioned outside the article according the invention; the outer face is in particular intended during operation to be oriented toward the rays emitted by the sun.

It should be noted that the color of the outer face and/or the inner face does not influence the far infrared emissivity properties of the main flexible panel. In fact, the emissivity of the white outer face of a textile panel was evaluated as being of the same order as that of the colored outer face (for example orange or green) of another textile panel, i.e., approximately 83-85%.

The article according to the invention may be a tent; preferably in that case, the tent includes an inner room. The article according to the invention may also be a shelter including a roof element, such as a parasol, an umbrella, a canopy, a blind.

The inner face of the main flexible panel is at least locally in contact with a layer of air, either a layer of air with a minimum thickness when the shelter area comprises an inner room, or directly in the volume of air of the shelter area.

The far infrared emissivity rate of the inner and outer faces may be measured using the method described below or according to standard NF EN 15976.

The emissivity values are given in the present text to within +/−3 percentage points.

The emissivity difference $\epsilon$ (%) between the inner face and the outer face is preferably at least 3% points, still more preferably at least 6% points.

Preferably, the main flexible panel is coated along its inner and/or outer face with a base polymer film, in particular not including any component having particular emissivity or reflection properties. This base polymer film serves to plug the pores of the inner face and/or the outer face of the main panel, to flatten and improve its draping. This base polymer thread also contributes to giving the main flexible panel properties to withstand abrasion and be impermeable to water. Preferably, the weight/m$^2$ of a base polymer film is less than or equal to 100 g/m$^2$, preferably less than or equal to 50 g/m$^2$, and still more preferably less than or equal to 10 g/m$^2$. In the case where the main flexible panel includes two base polymer films respectively positioned on its inner and outer faces, the sum of the weights/m$^2$ of the two films is less than or equal to 200 g/m$^2$, preferably less than or equal to 100 g/m$^2$, and still more preferably less than or equal to 20 g/m$^2$.

The weight/m$^2$ values of the films are given in the present text on the finished article when the films are dry (in particular the solvent or aqueous phase of the binding coating composition has been evaporated).

In one alternative, the emissivity rate (%) of the far infrared rays of the inner face is less than at least 10% points, preferably less than at least 20% points, at the emissivity rate (%) of the far infrared rays of the outer face.

The greater the emissivity difference between the outer and inner faces, the more the thermal radiation in the shelter area will be reduced, thereby improving the thermal comfort of the user.

In one alternative, the shelter area includes an inner room at least partially covered by said roof element, said roof element and the inner room being arranged so as to be spaced apart at least locally by a distance (d) by a layer of air, preferably by a distance (d) greater than or equal to 7 mm.

This layer of air positioned between the inner face of the main panel and the inner room is necessary so as not to alter the emissivity properties of the inner face and preserve the attenuation of the greenhouse effect observed in the shelter area.

The inner room is preferably obtained by assembling one or more precut flexible panels, in particular textile panels.

When the article according to the invention does not include such an inner room, the main panel making up the roof element is suspended above the shelter area, and the inner face of said main panel is in contact with the layer of air.

The outer face of the main panel being intended to be oriented directly across from the solar rays, the outer face is in contact with the ambient air, which thus also forms a layer of air on its surface in a certain manner.

In one alternative, the outer face of the main flexible panel has a reflection rate greater than or equal to 40%, measured according to standard NF EN 410.

This arrangement makes it possible to further improve the desired effect in the context of the invention, i.e., to decrease the proportion of the incident solar rays transmitted, then reemitted in the shelter area so as to limit the accumulation of far infrared rays in that area.

In one alternative, the outer face of the main flexible panel is at least partially coated with a first reflective component, and the inner face is at least partially coated with a second component, said first and second components being selected such that said first component has an emissivity of far infrared rays (%) greater than the emissivity of the far infrared rays (%) of the second component.

In one alternative, the first component and the second component are metal particles, optionally oxidized.

In one alternative, the first component is titanium dioxide and the second component is a powder of aluminum or silver.

In one alternative, the outer face is at least partially coated with a first film of a first polymer and said first component, said film optionally being colored.

The film may be colored by adding one or more color pigments.

Preferably, the base polymer film is positioned between the first film and the outer face of the main flexible panel.

In one alternative, the inner face is at least partially coated with a second film in at least one polymer capable of making said inner face impermeable to water, said second film optionally including said second component.

Preferably, the base polymer film is positioned between the inner face and the second film.

Preferably, the weight/$m^2$ of the first film and/or the second film is less than or equal to 100 g/$m^2$, preferably less than or equal to 50 g/$m^2$, still more preferably less than or equal to 10 g/$m^2$.

In one alternative, the polymer is chosen alone or in combination from among the following polymers: polytetrafluoroethylene, polyurethane, polyethylene terephthalate, ethyl vinyl acetate (EVA).

Said polymer corresponds to that involved in the composition of the base film and/or the first film and/or the second film.

Said polymer corresponds to the binder of the solvent-based or aqueous binding composition implemented by coating, for example using dip roller(s) and scraper(s) to forms said films.

In one alternative, the proportion by weight of the first component in said first film is less than or equal to 75%, preferably less than or equal to 50%.

The aforementioned values are given on the finished article.

Preferably, the proportion by weight of the first component relative to the total weight of the solvent-based or aqueous binding composition intended to forms the first film is less than or equal to 25%, still more preferably less than or equal to 20%.

In one alternative, the proportion by weight of the second component in the second film is less than or equal to 75%, preferably less than or equal to 50%.

The aforementioned values are given on the finished article.

Preferably, the proportion by weight of the second component relative to the total weight of the solvent-based or aqueous binding composition intended to form said second film is less than or equal to 25%, still more preferably less than or equal to 15%, and still more preferably less than or equal to 10%.

In the alternative embodiments described above, the first and second films may be obtained by coating with a polymer composition including a polymer and the first or second component, respectively. The coating may be done in a known manner using a dip roller or scraper.

The first and/or second films may also be rolled hot on the outer and/or inner face, respectively, of the main panel.

In one alternative, the inner face is completely or partially coated with a metallized film, in particular an aluminized film.

In that case, the aluminized film may be rolled hot along all or part of the inner face of the main flexible panel.

In one alternative, the main flexible panel is a textile panel.

The textile panels described in this text may be formed by one or more precut panels, formed from one or more fabrics and/or nonwovens and/or knits.

BRIEF DESCRIPTION OF THE DRAWINGS

The present invention will be better understood upon reading one example embodiment, cited as a non-limiting example, and illustrated by the figures described below and appended hereto, in which.

MORE DETAILED DESCRIPTION

Figure 1:
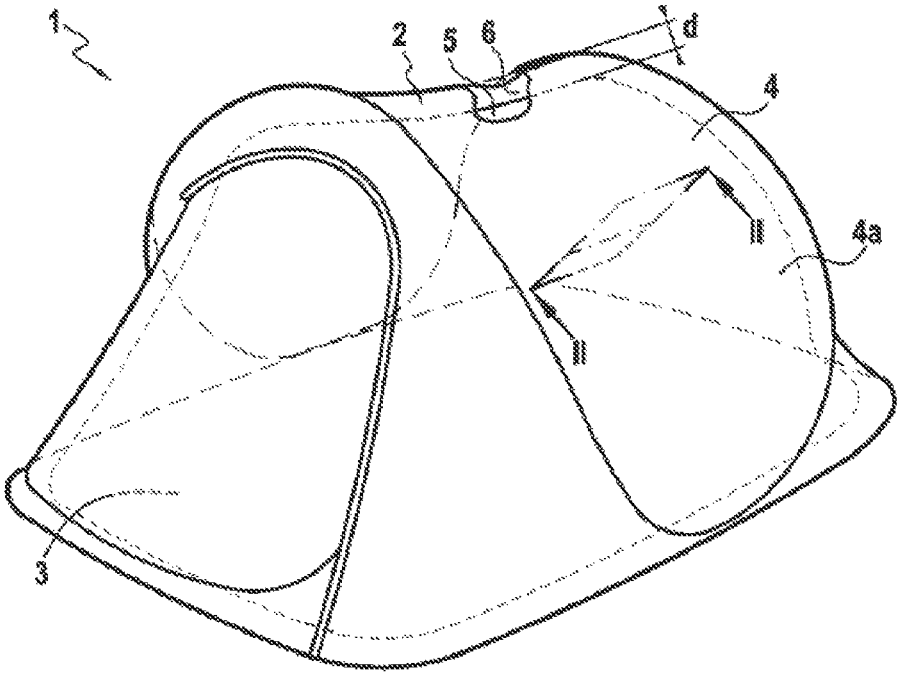
FIG. 1 is a diagrammatic perspective illustration of one example of an article of the tent type according to the invention.

The tent-type article 1, shown in FIG. 1, includes a roof element 2 covering a shelter area 3. The roof element 2 includes a main flexible panel 4 having offset outer 4*a* and inner 4*b* faces, the inner face 4*b* being intended during operation to be oriented across from said shelter area 3. The emissivity rate (%) of the infrared rays of the inner face 4*b* is lower than the emissivity rate of the infrared rays of the outer face 4*a*. The shelter area 3 includes an inner room 5, covered by the roof element 2, said roof element 2 and the inner room 5 being arranged so as to be at least locally separated by a distance (d) by a layer of air 6. In this specific example, the distance d is greater than or equal to 7 mm. Preferably, the emissivity rate of the inner face 4*b* is at least 20 percentage points lower than the emissivity rate of the outer face 4*a*.

The outer face 4*a* of the main flexible panel 4 is arranged so as to reflect the solar rays; preferably, the outer face 4*a* has a reflection rate greater than or equal to 40% (measured according to standard NF EN 410).

In this specific example, the outer face 4*a* is coated with a first polymer film 7 including oxidized metal particles, preferably titanium dioxide. The second inner face 4*b* is coated with a second polymer film 8 including non-oxidized metal particles, preferably aluminum powder. The first and second polymer films 7, 8 are preferably made from one or more polymers selected from among the following polymers: polyethylene terephthalate, polyurethane, polytetrafluoroethylene, ethyl vinyl acetate.

Figures 3, 4:
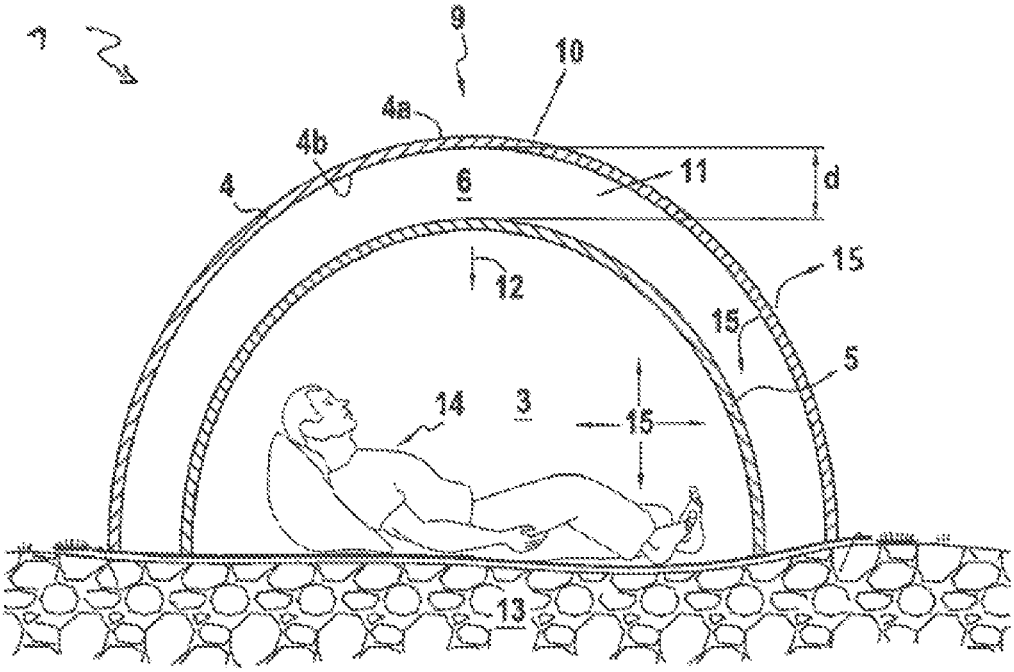
FIG. 3 is a diagrammatic illustration of the attenuation of the greenhouse effect observed in the shelter area of the article described in FIG. 1.
FIG. 4 is a table illustrating the transmission and reflection properties of the solar radiation as well as the emissivity in the far infrared of different samples (nos. 2-4) of the main flexible panels compared to a main flexible panel of the state of the art (sample 1).

FIG. 4 thus illustrates the transmission and reflection properties of different samples of flexible panels measured according to standard NF EN 410. Sample no. 1 of the state of the art is a textile panel whereof the outer face is not coated with any film and whereof the inner face is coated with a polyurethane film not including any component having a particular reflection or emissivity function, in particular not including metal particles, whether oxidized or not. Sample no. 2 corresponds to a textile panel whereof only the outer face has been coated with a polymer film including aluminum powder. Sample no. 3 corresponds to a textile panel whereof only the outer face has been coated with a polymer film including titanium dioxide. Sample no. 4 corresponds to the main flexible panel 4 according to the invention. The flexible textile panels from which samples 1 to 4 have been prepared are the same; in particular, they are woven with polyester threads. The portion of titanium dioxide and aluminum powder is substantially the same in each of the polymer films. Lastly, the polymer film has a polyurethane base. In this specific example, the outer 4*a* and inner 4*b* faces are also coated with a base polymer film, whereof the weight/$m^2$ is preferably less than or equal to 10 g/$m^2$. The base polymer films are interposed between the inner and outer faces and the first and second polymer films including the first and second components, respectively.

In one alternative, the proportion by weight of the first and second components in the first and second films differ, respectively. In that case, the solvent-based or aqueous binding composition intended to form the first film includes between 15 and 20 wt % of $TiO_2$ relative to its total weight, and the solvent-based or aqueous binding composition intended to form the second film includes between 4 and 12 wt % of silver powder relative to its total weight.

The absorption rate was deduced from the transmission and reflection rates. The transmission, reflection and absorption rates on the solar spectrum were measured by incident radiation emitted toward the outer face of the samples to be tested. The far infrared emissivity rate of the inner and/or outer faces was measured using a measuring method described below using an emissometer from the INGLAS brand referenced TIR 100-2.

The transmission, reflection and emissivity values are provided to within plus or minus 3%.

Preferably, the transmission and reflection values are provided to within 1% point and 2% points, respectively.

It can thus be observed that the emissivity rate of the outer face of the panel of state of the art is high, since it is 80%. The emissivity rate of the outer face of sample no. 2 was low, since it is 55%, as well as the transmission of the rays on the solar spectrum, which is also low because it is 7%. The emissivity rate of the outer face of sample no. 3 is high, since it is 79%, and close to that of sample no. 1 of the state of the art, but has a good reflection of the solar rays, since it is 44%.

The emissivity rates of the inner faces of samples nos. 1, 2 and 3 are theoretically of the same order, since none of these inner faces is coated with a film including a component having a particular reflection or emissivity function. The emissivity of the inner faces of samples nos. 1, 2 and 3 is thus of the same order as that measured for the outer face of sample no. 1, i.e., 80% to within plus or minus 3%. Thus, the emissivity of the inner and outer faces of samples no. 1 and no. 3 are of the same order, while the emissivity of the inner face of sample no. 2, of approximately 80% to within 3%, is much higher than that of the outer face coated with a film comprising aluminum particles, which is 55% to within plus or minus 3%.

The emissivity rate of the inner face 4*b* of the main flexible panel 4 (sample no. 4) is 58%, which is at least 20 percentage points lower than the emissivity rate of 83% of the outer face 4*a*.

During operation, the incident solar rays 9 arrive on the outer face 4*a* of the main panel 4, one part 10 of those rays are reflected, another part 11 is absorbed, and lastly a final part 12 is transmitted. Thus, the proportion of the transmitted solar rays 12 in the tent 1 (approximately 8%) is lower than in the state of the art (approximately 34%), since the outer face 4*a* is arranged so as to reflect the solar rays. The transmitted rays 12 in the shelter area 3, as shown in FIG. 3, are reflected again or absorbed, then reemitted in the far infrared by the ground 13, the skin of any users 14, and the walls of the inner room 5 to form radiation in the far infrared represented by the arrows 15. When these rays 15 are reemitted by the walls of the inner room 5 toward the main flexible panel 4, they are again absorbed by the main panel 4. Owing to the emissivity properties of the faces 4*a* and 4*b* of the main flexible panel 4, the radiation thus absorbed by the panel 4, either directly from the incident solar radiation 9 (part 11), or indirectly from the far infrared radiation 15, is better reemitted by the outer face 4*a* in the atmosphere than through the inner face 4*b* toward the shelter area 3. In this entire cycle, the greenhouse effect is thus considerably decreased relative to what is observed in the state of the art for a known tent equipped with a roof element including a main panel such as sample no. 1.

Figure 2:
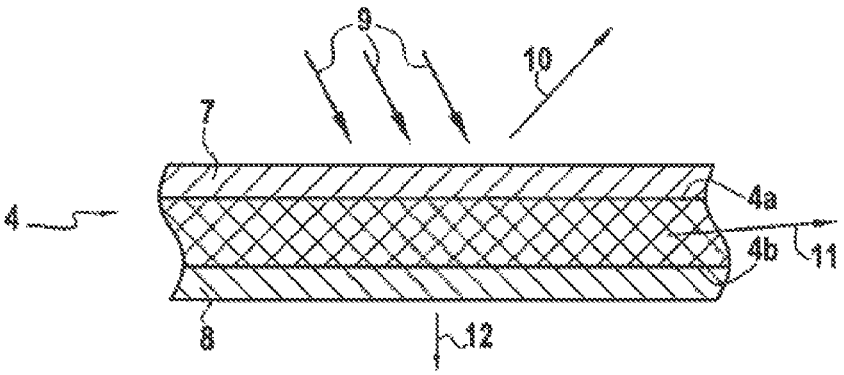
FIG. 2 is an illustration along the cutting plane II-II done in FIG. 1, of the main flexible panel.

A climate blowing study on the tent-type article 1 described in FIGS. 1 to 3 was conducted compared to an article of the same structure including a roof element having a main panel of the state of the art (sample no. 1). The article 1 is positioned in a room having a ceiling formed so as to emit rays on the solar spectrum. The climate parameters of the blowing are determined in said room so as to reproduce a summer day at European latitudes with very low wind. The energy emitted by the ceiling of said room is approximately 600 watts/$m^2$ on the ground. Thermocouples, a black globe and radiative flow sensors (pyranometers) respectively make it possible to measure the temperature of the atmosphere (outside said articles), the radiant temperature in the shelter area, and the transmission rate of the article in the shelter area (the radiative flow sensors are placed on the outer face 4*a* of the main panel 4 as well as on the floor in the inner room 5 and equivalently for the article of the state of the art). A decrease of 6° C. is thus observed on the radiant temperature between the article 1 and the article of the state of the art, as well as a decrease of 2° C. of the air in the shelter area 3 relative to the shelter area of the state of the art and a transmission rate of the solar radiation divided by 4 in the shelter area 3. The radiant temperature is related to the solar and/or far infrared thermal radiation absorbed by a user's skin, and the significant decrease of that criterion thus allows a clear improvement in the user's thermal comfort, since said user feels less heat.

It should be noted that the capacities to emit solar radiation of the climate blowing in which this test was done were limited to 600 watts/$m^2$ on the floor, whereas the usage conditions in summertime with a completely clear sky would be closer to an emission of 800-1000 watts/$m^2$ on the floor. The reduction of the thermal radiation and the radiant temperature relative to the state of the art should be more pronounced for these usage conditions.

The far infrared emissivity rates described in the context of the present invention may be measured according to European standard EN 15976 or according to the test method described below.

This method is an indirect measurement of the emissivity, and more particularly the hemispherical emissivity. Thus, a hemispherical black body, at a temperature of 100° C., radiates toward a given face of a sample whereof one wishes to measure the emissivity. The portion of the thermal flow reflected by said face of the sample is then measured using an emissometer. The emissivity is thus deduced from Kirchoff's law of energy conservation: (1=tau+alpha+rho), in which tau is the transmission coefficient, rho is the reflectivity coefficient, and alpha is the absorption coefficient. Starting from the postulate that the main flexible panels of samples 1 to 4 are opaque to far infrared radiation, tau is zero in this wavelength range (it therefore corresponds to the far infrared). It is additionally considered that the wavelength is monochromatic, since we are in the far infrared for the reflection and the emissivity such that the emissivity (epsilon) is equal to the value alpha in Kirchoff's law stated above; thus, the emissivity is equal to 1-rho. The measurement of the emissivity is done with a INGLAS-brand TIR100-2 emissometer. Two standards with a low emissivity and high emissivity, respectively, are used beforehand to calibrate the measuring method. One thus more precisely measures the hemispheric emissivity of the far infrared rays, which in fact corresponds to the production of radiant heat.

The invention claimed is:

1. An article comprising a roof element at least partially covering a shelter area, said roof element including a flexible main panel having opposite outer and inner faces, the inner face being intended during operation to be oriented across from said shelter area, the outer face being intended during operation to be oriented across from the sun's rays, wherein said inner face has an emissivity rate (%) of far infrared rays lower than the emissivity rate (%) of far infrared rays of said outer face, and wherein said outer face is arranged so as to reflect the solar rays, and wherein the article is one of a tent or a shelter.

2. The article according to claim 1, wherein said emissivity rate (%) of the far infrared rays of the inner face is less than at least 10% points at the emissivity rate (%) of the far infrared rays of said outer face.

3. The article according to claim 2, wherein said emissivity rate (%) of the far infrared rays of the inner face is less than at least 20% points, at the emissivity rate (%) of the far infrared rays of said outer face.

4. The article according to claim 1, wherein said shelter area includes an inner room at least partially covered by said roof element, said roof element and the inner room being arranged so as to be spaced apart at least locally by a layer of air having a width d.

5. The article according to claim 4, wherein d is greater than or equal to 7 mm.

6. The article according to claim 1, wherein said outer face of the main flexible panel has a reflection rate greater than or equal to 40%, measured according to standard NF EN 410 April 2011.

7. The article according to claim 1, wherein said outer face of the main flexible panel is at least partially coated with a first reflective component, and said inner face is at least partially coated with a second component, said first and second components being selected such that said first component has an emissivity of far infrared rays (%) greater than the emissivity of the far infrared rays (%) of said second component.

8. The article according to claim 7, wherein said first component and said second component are metal particles.

9. The article according to claim 7, wherein said first component is titanium dioxide and said second component is a powder of aluminum or silver.

10. The article according to claim 7, wherein said outer face is at least partially coated with a first film of a first polymer and said first component.

11. The article according to claim 10, wherein said first film is colored.

12. The article according to claim 10, wherein said inner face is at least partially coated with a second film in at least one polymer capable of making said inner face impermeable to water.

13. The article according to claim 12, wherein said second film includes said second component.

14. The article according to 12, wherein proportion by weight of the second component in the second film is less than or equal to 75%.

15. The article according to 14, wherein said proportion by weight of the second component in the second film is less than or equal to 50%.

16. The article according to claim 10, wherein said polymer is chosen alone or in combination from among the following polymers: polytetrafluoroethylene, polyurethane, polyethylene terephthalate, ethyl vinyl acetate (EVA).

17. The article according to claim 10, wherein proportion by weight of the first component in said first film is less than or equal to 75%.

18. The article according to claim 17, wherein said proportion by weight of the first component in said first film is less than or equal to 50%.

19. The article according to claim 1, wherein said inner face is completely or partially coated with a metallized film.

20. The article according to claim 1, wherein said inner face is completely or partially coated with an aluminized film.

21. The article according to claim 1, wherein said main flexible panel is a textile panel.

22. The article according to claim 1, wherein the shelter is one of a parasol, an umbrella, a canopy, or a blind.

* * * * *